United States Patent [19]

Kuznetsov

[11] Patent Number: 4,635,705

[45] Date of Patent: Jan. 13, 1987

[54] DOUBLE-SIDED ELECTROMAGNETIC PUMP WITH CONTROLLABLE NORMAL FORCE FOR RAPID SOLIDIFICATION OF LIQUID METALS

[75] Inventor: Stephen B. Kuznetsov, Pittsburgh, Pa.

[73] Assignee: Westinghouse Electric Corp., Pittsburgh, Pa.

[21] Appl. No.: 561,426

[22] Filed: Dec. 14, 1983

[51] Int. Cl.[4] ..... B22D 27/02

[52] U.S. Cl. ..... 164/466; 164/429; 164/502

[58] Field of Search ..... 164/146, 147.1, 423, 164/427, 429, 463, 466, 467, 479, 502, 503

[56] References Cited

U.S. PATENT DOCUMENTS

| | | | |
|---|---|---|---|
| 2,083,022 | 6/1937 | Jones et al. | 164/35 |
| 3,624,572 | 11/1971 | Mallinson et al. | 325/209 |
| 3,754,634 | 8/1973 | Gerbig et al. | 164/337 |
| 3,933,193 | 1/1976 | Baker et al. | 164/432 |
| 3,980,284 | 9/1976 | Shigihara et al. | 164/147.1 |
| 4,324,266 | 4/1982 | Garnier et al. | 164/147.1 |
| 4,461,338 | 7/1984 | Sundberg | 164/466 |

FOREIGN PATENT DOCUMENTS

| | | | |
|---|---|---|---|
| 52-23602 | 6/1977 | Japan . | |
| 57-177861 | 11/1982 | Japan | 164/466 |

*Primary Examiner*—Nicholas P. Godici
*Assistant Examiner*—Richard K. Seidel
*Attorney, Agent, or Firm*—R. P. Lenart

[57] ABSTRACT

A system for casting liquid metals is provided with an electromagnetic pump which includes a pair of primary blocks each having a polyphase winding and being positioned to form a gap through which a movable conductive heat sink passes. A solidifying liquid metal sheet is deposited on the heat sink and the heat sink and sheet are held in compression by forces produced as a result of current flow through the polyphase windings. Shaded-pole interaction between the primary windings, heat sink and solidifying strip produce transverse forces which act to center the strip on the heat sink.

12 Claims, 5 Drawing Figures

DOUBLE-SIDED ELECTROMAGNETIC PUMP WITH CONTROLLABLE NORMAL FORCE FOR RAPID SOLIDIFICATION OF LIQUID METALS

STATEMENT OF GOVERNMENT INTEREST

The U.S. Government has rights in this invention pursuant to Contract No. DE-AC07-831D12443, between the Department of Energy and Westinghouse Electric Corporation.

BACKGROUND OF THE INVENTION

This invention relates to casting of liquid metals and more particularly to casting systems which include a double-sided electromagnetic pump that electromagnetically induces forces on a liquid metal strip undergoing solidification and an associated moving conductive heat sink.

Over the past decade, a significant energy reduction in the steel-making process has arisen from the use of continuous slab casting technology, where steel is cast directly from the melt. An improvement in rapid solidification has arisen for the production of thin strip known as melt spinning. Here, specimens are cast directly from the melt into strips having a thickness of from 0.254 to 1.27 mm (0.01 to 0.05 inches) using a conveyor or drum assembly chilled to below the solidification temperature at belt or wheel peripheral speeds of between about 10 and 23 meters per second.

Rapid solidification, where heat is extracted from the strip by a cold, high conductivity wheel, is the preferred method of processing ferrous metals. The rate at which the strip is produced is determined by the rate of heat extraction. Even where the heat transfer is high, the liquid does not acquire the full conveyor velocity before it freezes, at which instance the specimen velocity is equal to that of the conveyor.

The solidification region on the conveyor varies according to the conveyor linear speed for a given ribbon thickness. For example, at a conveyor speed of 23 meters per second, strips having a thickness of 0.63 mm. (25 mils) are practical at solidification lengths of 50 cm. and wheel temperatures of 350° K.

Double-sided electromagnetic pumps which may be used in strip casting systems include an upper and lower primary block, each having a polyphase winding and being positioned to form a gap therebetween. A movable heat sink, such as a conveyor belt, is disposed within the gap and means are provided for depositing liquid metal onto the heat sink. Both the metal specimen, assumed to be non-ferromagnetic since its temperature is always above the Curie temperature, and the heat sink form a secondary circuit for the induction of slip frequency currents. The synchronous field speed, $v_s$, of the traveling wave set up by the two primary members is determined according to the relation:

$$v_s = 2\tau_p f \quad (1)$$

where $\tau_p$ is the pole pitch of the primary in meters and f is the excitation frequency in hertz. If the peripheral or linear speed of the conveyor is $v_r$, then the per unit slip, s, is defined as the difference between synchronous and actual speed with respect to synchronous speed. As the belt speed is reduced slightly from synchronous speed, for example, less than 23 meters per second, current density builds up linearly with slip and power dissipation in the secondary builds up as the square of the change in slip over the small slip range.

In a conventional electromagnetic pump, using a double-sided primary induction member and a secondary conducting structure symmetrical about an air gap mechanical centerline, the only appreciable force is the longitudinal or tangential force imparting motion on the strip secondary. Radial or normal force, while still available, is balanced by each primary structure to zero effective force.

Double-sided pumps used for strip casting have asymmetrical secondaries due to the fact that a sandwich-type arrangement is required, for example, by the use of a highly conductive heat sink member which travels in synchronism with a highly resistive liquid metal member which is undergoing solidification. In most instances, the thickness of these two components will be different and most importantly the effective surface resistivity of these will widely differ aside from their intrinsic differences in volume resistivity.

According to the slip, frequencies and conductivities involved, the normal force on a non-ferromagnetic member can attract the member to a primary block or repel it. Controlling the amount of attraction or repulsion is a crucial aspect in improving the production rates of continuously cast metals. Therefore, it is essential that the operating conditions of the electromagnetic system which produce the tensioning or longitudinal force be consistent with the normal force requirements, which for these two-dimensional forces will necessarily peak at different slip values. The ratio of the normal to longitudinal forces for a double-sided electromagnetic pump is primarily a function of the magnetic Reynold's number, which includes a dependence on the effective air gap.

SUMMARY OF THE INVENTION

In a casting system having a double-sided electromagnetic pump constructed in accordance with the present invention, radial or normal forces attributed to each primary member do not cancel. In general, the movable heat sink member is repelled by a lower primary block with a magnitude of force which exceeds the repulsion force from an upper primary block. This is primarily due to the smaller air gap of the heat sink with respect to the lower primary block. For temperatures above the Curie temperature, a solidfying metal strip will be repelled by the upper primary block at a force greater than the repulsion force from the lower primary block. These normal force conditions can be maximized to obtain a net compressive force between the movable heat sink and solidifying liquid metal strip, thereby ensuring a high, uniform surface contact for heat transfer. More rapid heat transfer from the strip to the heat sink allows the use of increased production rates.

A liquid metal casting system having a double-sided electromagnetic pump in accordance with this invention comprises: an upper primary block including a plurality of slots adjacent to one side thereof and a first polyphase winding passing through these slots; a lower primary block including a plurality of slots adjacent to one side thereof and a second polyphase winding passing through the slots, with said upper and lower primary blocks being positioned to form a gap therebetween; a movable conductive heat sink disposed within the gap; and a nozzle or other means for depositing liquid metal onto the heat sink. Normal forces on the heat sink and liquid metal being solidified which result from excitation of the first and second polyphase windings hold the heat sink and liquid metal in compression, thereby reducing fluctuations in surface contact pressure and heat transfer capability.

The movable heat sink may be configured to achieve shaded pole electromagnetic interaction which continuously, laterally centralizes the solidifying metal strip over the heat sink surface at high speeds.

DESCRIPTION OF THE PREFERRED EMBODIMENTS

Figure 1:
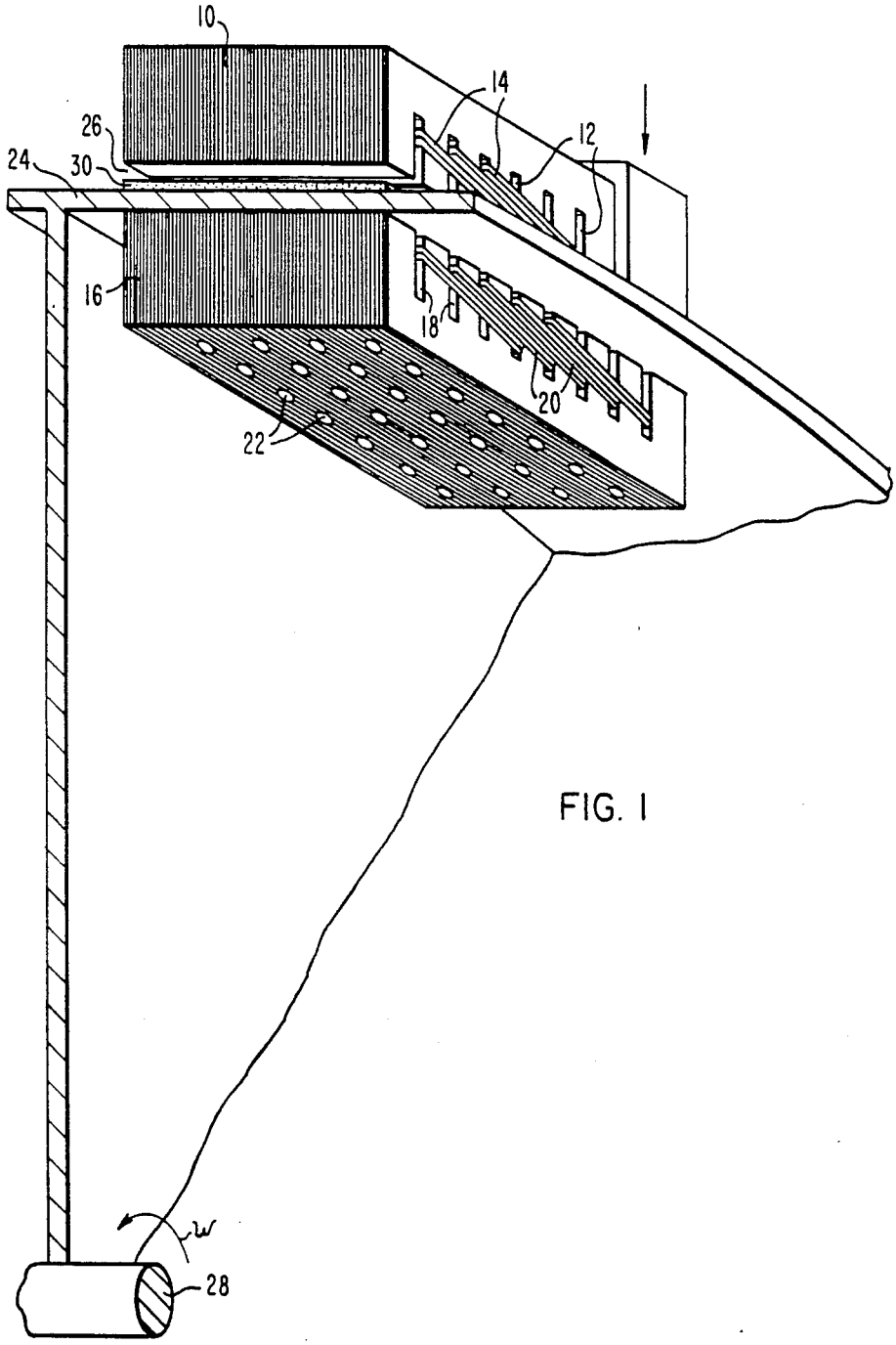
FIG. 1 is a pictorial representation of a casting system constructed in accordance with one embodiment of the present invention.

Referring to the drawings, FIG. 1 is a pictorial representation of a portion of a liquid metal casting system constructed in accordance with one embodiment of the present invention. The system includes an upper primary block 10 having a plurality of slots 12 adjacent to one side thereof and a first polyphase winding 14 passing through these slots. A lower primary block 16 includes a plurality of slots 18 and a second polyphase winding 20 passing through these slots. A plurality of cooling passages 22 are provided for the injection of coolant through lower primary block 16. A movable conductive heat sink 24 is disposed within a gap 26 between the upper and lower primary blocks and mounted for rotation about shaft 28. Although a rotating heat sink structure is shown, it should be understood that other movable heat sink structures, such as a conveyor belt, also fall within the scope of this invention. A metal strip 30 which is undergoing solidification is positioned on the surface of heat sink structure 24.

Figure 2:
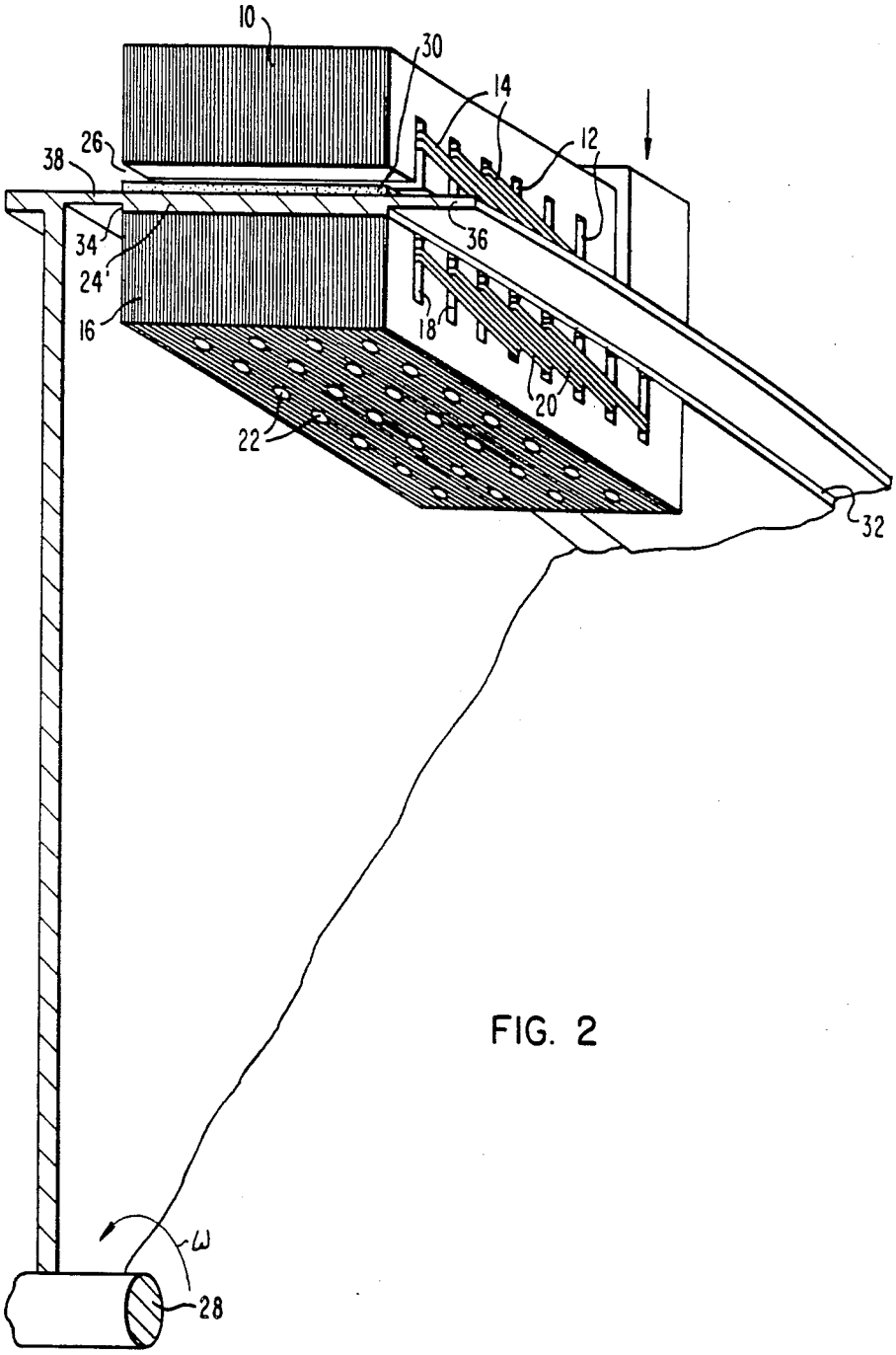
FIG. 2 is a pictorial representation of an alternative embodiment of the casting system of FIG. 1 wherein the movable heat sink is configured to enhance shaded pole interaction which acts to center the solidifying metal strip.

FIG. 2 is a pictorial representation of a portion of a casting system constructed in accordance with this invention which is similar to that of FIG. 1 but includes a movable heat sink member 24' which is configured to enhance shaded pole interaction with the primary members to develop transverse electromagnetic forces which act to center the solidifying metal strip 30 on the heat sink surface. This is achieved through the use of step reductions in heat sink thickness 32 and 34 which are in line with the sides of primary blocks 10 and 16 such that the overhang portions 36 and 38 of heat sink 24' which extend beyond the sides of the primary blocks have a thickness which is less than that of the central portion of heat sink 24'. It is evident that there are no mechanical guides on the upper surface of heat sink 24' which would center strip 20.

Figure 3:
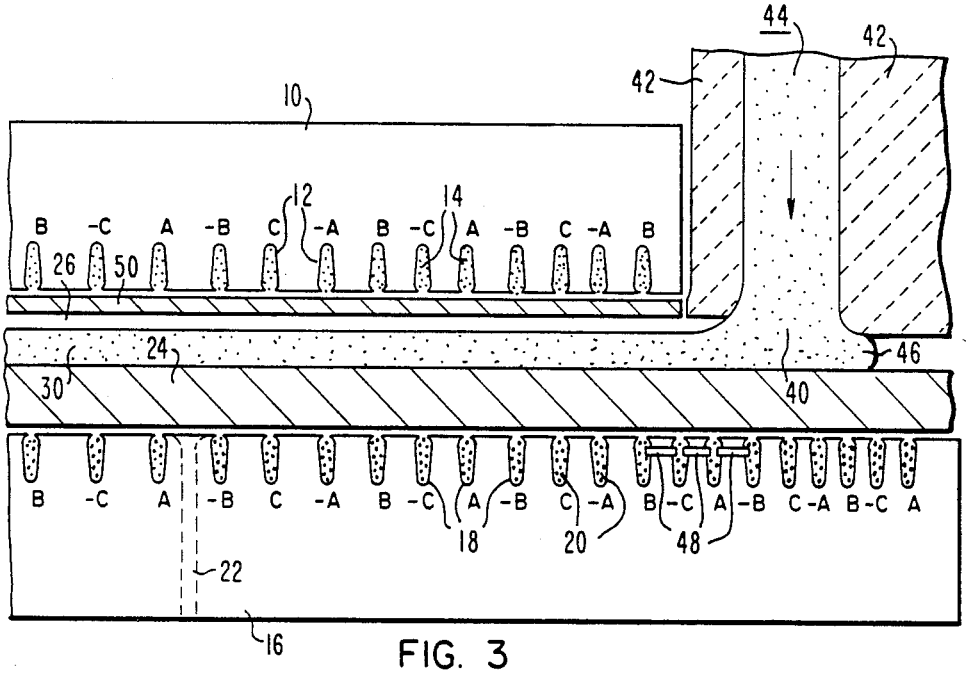
FIG. 3 is a cross section of a portion of a casting system constructed in accordance with this invention.

FIG. 3 is a cross section of a liquid metal casting system constructed in accordance with one embodiment of this invention. A nozzle 40 is provided in containment structure 42 for the injection of liquid metal 44 onto the movable heat sink structure 24. The liquid metal initially forms a puddle 46 and is drawn into a solidifying sheet 30. Shading coils 48 are shown to be positioned on teeth in lower primary block 16 formed between adjacent slots 18. A conductive compensation sheet 50 is shown to be positioned adjacent to the lower surface of upper primary block 10, facing the air gap 26, so as to balance the net normal force and longitudinal force contributions between the upper and lower primary blocks. The dimensions of this compensation sheet will be determined in consideration of the thickness and surface resistivity of the heat sink surface. The phases of the polyphase windings are designated by letters A, B and C in the conventional manner.

Figure 4:
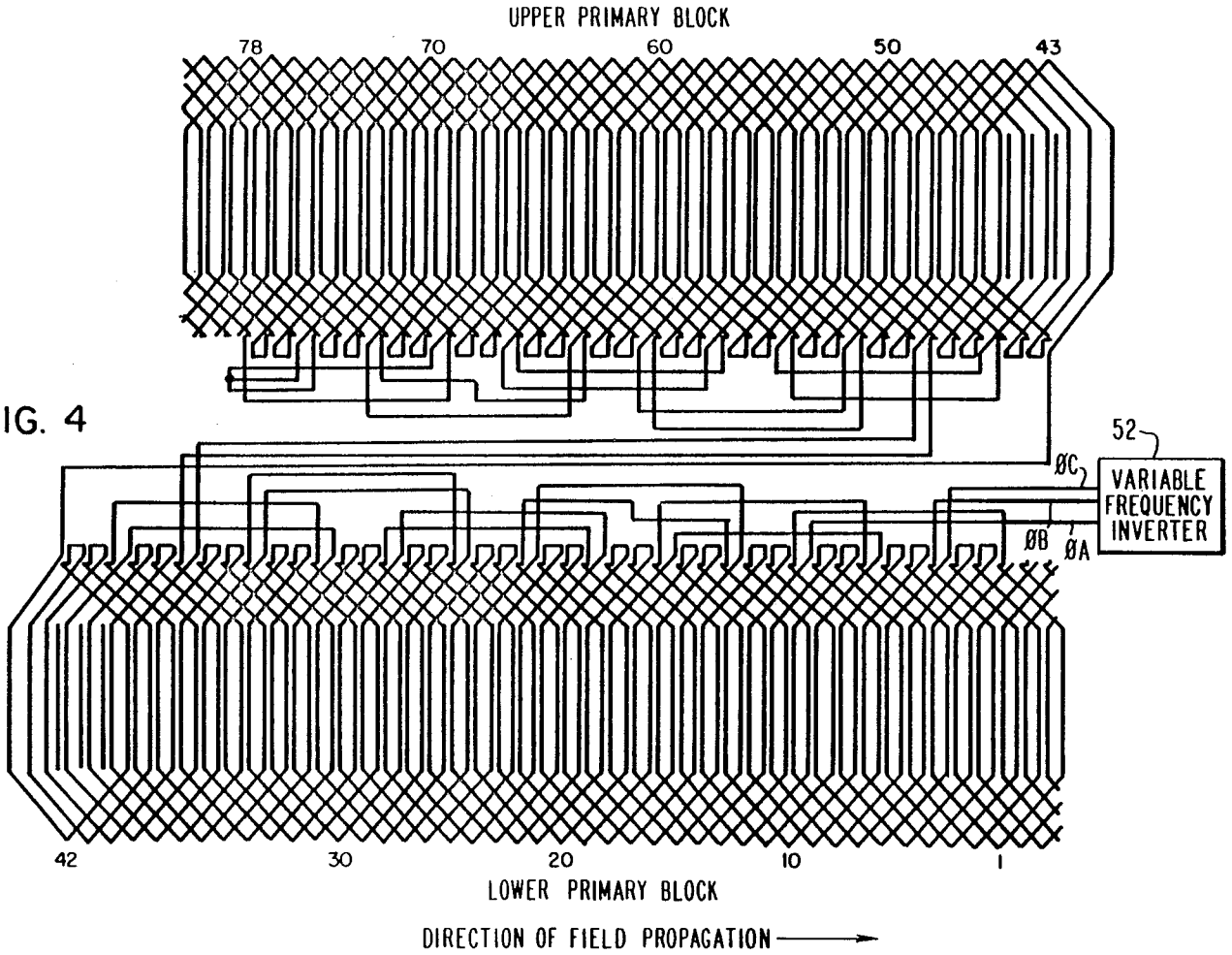
FIG. 4 is a winding diagram for the casting system of FIG. 3.

FIG. 4 is a wiring diagram for the casting system of FIG. 3 wherein the first polyphase winding includes coils numbered 1 though 42 and the second polyphase winding includes coils numbered 43 through 78. By way of example, a configuration with three slots per pole per phase is shown.

The excitation for the windings of the upper and lower primary blocks estabishes a traveling wave of magnetomotive force which may be modeled in the form:

$$J_s = \text{Real}[J \exp(j(\omega t - y2\pi/\lambda))] \quad (2)$$

wherein J is the surface current loading in terms of ampere-turns per linear meter, $\omega$ is the angular excitation frequency, y is the longitudinal distance, and $\lambda$ is the wavelength. The thrust in the longitudinal or y direction and the normal force in the radial or z direction may be derived independently. From Maxwell's second stress tensor, the longitudinal force, $F_y$, is:

$$F_y = P_2/\lambda f \text{ N/m}^2 \quad (3)$$

and the normal force, $F_z$, is:

$$F_z = \left(\frac{\mu_o}{4}\right)\left\{|J|^2 - \frac{B_1^2}{\mu_o^2}\right\} \text{ N/m}^2 \quad (4)$$

where $\lambda$ is the wavelength in meters or twice the pole pitch of the winding, f is the frequency of excitation in hertz, $P_2$ is the power radiated in the normal direction from a current sheet on the upper surface of lower primary block 16, and $B_1$ is the normal component of the flux density at the upper surface of lower primary block 16 in peak-Teslas. In a design example with a heat sink speed of 23 meters per second and a suggested excitation frequency of 900 hertz, values for various parameters can be calculated such that the pole pitch must be 12.8 mm. or greater. If a pole pitch of 20 mm. is selected for a base design, the wavelength would be 40 mm. and consequently the longitudinal force would be 0.0277 $P_2$ Newtons/m$^2$ for a power input of $P_2$ watts/m$^2$ in the combined secondary. Due to the magnitude of $P_2$ and its effect on heating of the conveyor, an upper limit on the longitudinal force $F_y$ is readily obtained. In evaluating the normal force from equation (4), J is the current loading in peak amperes per meter and is calculated in a three-phase double layer system, as:

$$J = 12NI/\lambda \quad (5)$$

wherein N is the number of turns in series per pole and I is the peak value of the phase current.

A moderately high value of current loading is 100,000 amps per meter peak and a typical flux density of 0.125 Tesla peak yields a net normal force of zero. Thus, according to equation (4), any current loadings in excess of this amount or flux densities below this value with the other parameters constant will produce a net positive or repulsive normal force $F_z$. In practice, current loadings less than 100 kA per meter and flux densities greater than 0.125 Tesla will suffice for the repulsion requirement. This normal force $F_z$ is the total repulsion force acting across the air gap, on the heat sink, solidifying strip, and upper primary block, exerted by the lower primary block windings.

The normal force may also be expressed in terms of surface impedance, which is defined as the ratio of electric field strength to magnetic field strength. In this case, the normal force is:

$$F_z = \frac{\mu_o}{4} |J|^2 \left\{ 1 - \left( \frac{|Z_2|}{\mu_o f \lambda} \right) \right\}^2 \quad (6)$$

where $\mu_o$ is the magnetic permeability of free space and $Z_2$ is the impedance of the air gap between the heat sink and the lower primary block at the upper surface of the lower primary block.

For the heat sink, the Reynold's number for an assumed temperature of 900° K. to 1100° K. and an assumed resistivity of $7.7\times10^{-8}$ ohm-meter, is $R_{HS}=3.74$ at an applied frequency of 900 Hz.

In the metal strip which is undergoing solidification, with an assumed resistivity of 120 microhm-cm., the Reynold's number is $R_{MS}=0.24$ at 900 Hz.

For the ferromagnetic upper primary block, the Reynold's number is:

$$R_{UB} = \frac{\mu_o \mu_r f \lambda^2}{2\pi \rho_{UB}} \quad (7)$$

With assumed values of $\mu_r=1000$ and $\rho_{UB}=12\times10^{-8}$ ohm-meter, this yields a Reynold's number of $R_{UB}=2400$.

When the various component impedances are calculated, the heat sink can be shown to produce a significant phase shift in surface impedance while the solidifying metal strip produces no appreciable phase shift. Therefore, it is convenient to classify the solidifying strip as being resistance limited in induction while the conductive heat sink is approaching an inductance limited condition.

Figure 5:
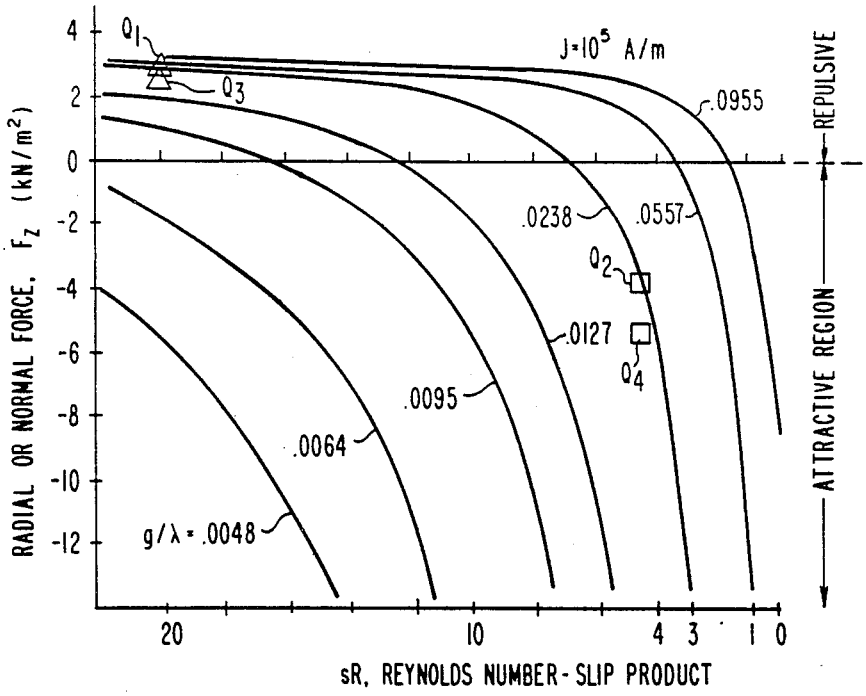
FIG. 5 is a graph which illustrates the relationships between radial or normal force, the Reynold's number-slip product and the gap to wavelength ratio.

From this discussion it can be seen that the normal force exerted by each primary block is a function of only two dimensionless parameters: the quotient of the air gap width g to wavelength λ; and the product of slip s times Reynold's number R. The ratio of g to λ will be fixed for any given design and thus it is through variation in the sR product parameter that a controllable normal force is obtained, noting that the heat sink will have a different and higher Reynold's number than the solidifying strip. Using equation (6), FIG. 5 plots the normal force for a constant current excitation of $J=10^5$ amps/meter peak, where the triangular data point, $Q_1$, represents a typical heat sink conveyor operating scheme and the square symbol, $Q_2$, represents the attractive force on the solidifying strip as exerted by the lower primary block.

Since it is imperative that both the heat sink and the solidifying strip are operated at the same slip, the locations of operating points $Q_1$ and $Q_2$ are different, indicating the differences in magnetic Reynolds number, R. Point $Q_1$ is positioned for an sR product of 22, whereas point $Q_2$ indicates an sR product of about 4.5. These represent the case of a slightly greater attractive pressure applied by the lower primary block of, for example, −4 kN/M², on the solidfying metal than the repulsive force exerted on the heat sink, for example 3 kN/M². This may be obtained by operating each primary block at an excitation such that the mechanical slip, s, is for example 0.25 per unit, dictating that the Reynolds number for the heat sink should be 22/0.25 or 88, and the Reynolds number for the solidifying metal should be 4.5/0.25 or 18. These Reynolds numbers are typical for materials in larger casting systems wherein the wavelength, λ, is large. For this example, the net effect of sandwiching the heat sink and solidifying metal is a compressive pressure of about 1.0 kN/M².

One advantage of controlling electromagnetic forces in accordance with this invention is that the same general force distribution is independently available from the matching upper primary block with the exceptions that: the repulsive forces of one block will counteract the repulsive forces of the other block of the same moving heat sink and metal strip due to their geometrical and vertical stacking orientation differences; and the curves appropriate to each block must consider the change in air gap involved and therefore the curves having the appropriate g/λ value must be used, with the wavelength, λ, frequency, f, and slip, s, remaining the same for both primary blocks.

To illustrate the appropriate parametric curves the upper primary block, points $Q_3$ and $Q_4$ are shown to indicate the running of the upper block at a slightly smaller air gap than the normalized air gap of 0.0238 used for the lower block. Therefore, as shown in FIG. 5, the attractive force as represented by point $Q_4$ is about −5.5 kN/M² while the repulsive force at point $Q_3$ is near 2.5 kN/M². The net effect on the composite secondary is then an attractive force of 3 kN/m² acting, for example upward, simultaneously with the other net attractive force of 1 kN/M² which is acting in the downward direction. In contrast, if the upper primary block is operated with an air gap larger than that of the lower primary block, the normal forces on the composite secondary could be exactly canceled or even net repulsive. The choice of air gap may be fixed at construction but the operating slip may be changed at will by using a variable frequency power source, 52, as shown in FIG. 4.

In order to obtain a constant radially directed force over a broader range of slip values, it is necessary to add a static compensation sheet 50 as shown in FIG. 3 to the air gap surface of the upper primary block. The objective of this sheet is to produce an effective surface impedance about equal to that provided by the moving heat sink/solidifying strip surface. Since the minimum heat sink temperature will be close to 500° K. while the static compensation sheet will not exceed 250° K., the thickness of this sheet should be approximately one-half of that of the heat sink, for example, 40 mils. The compensation sheet acts to balance the radiated electromagnetic power from each primary.

The double-sided electromagnetic pump wiring diagram as shown in FIG. 4 is suitable for a specific case of a thick steel strip which requires large pole pitches. In thin strip solidification technology, short pole pitches would allow a one slot per pole per phase winding. In materials of, for example, 50 mil thickness, large pole pitches are best obtained by changing to two or three slots per pole per phase rather than opening up the slot at the air gap as magnetic core material becomes more available. The winding arrangement shown in FIG. 4 yields a very low harmonic current factor due to the more gradual phase changes of 15° rather than the 60° slot-phase jumps found in conventional AC machines. For the double-sided pump described, the upper block primary should contain 36, 24 or 12 slots according to the number of slots per pole per phase to form four complete poles. The lower primary block, extending under the nozzle region, should contain multiples of 14 coils, for example, 42 coils. This results in an apparent $4\frac{2}{3}$ poles for the lower primary block. There is a fundamental advantage in having a non-integral number of poles in a non-continuous layout. The effect of the non-integral poles, n, is to cause the efficiency to peak at a lower slip value, s, according to the relation that $ns/(1-s)$ is constant. The smaller operating slip directly translates to a higher operating conversion efficiency.

In addition to control of the normal forces as described above, casting systems having electromagnetic pumps in accordance with this invention also exert a degree of control of the transverse forces on the solidifying metal strip. Although most of the control of the width of the solidifying metal strip depends on the mechanical construction of the nozzle, it is desirable to keep the width of this metal strip uniform and regular. Electromagnetic forces are useful, not in the specific formation of the strip width, but in insuring that once the strip is being solidified, it stays centered over the heat sink surface. Due to shaded pole interaction between the primary blocks and the solidifying strip which produce restraining transverse forces, it is essential that the nozzle width or the resulting strip width be exactly as wide as the primary block to guarantee sufficient lateral restoring forces. This width equality is illustrated in FIGS. 1 and 2. In FIG. 2, shaded pole side interaction is increased by the use of step changes in thickness of the conductive heat sink at the edges of the primary block.

The effect is that an inward traveling field is produced at the interface on both sides, stabilizing or centralizing the solidifying steel strip on the heat sink surface. If transverse forces from external means cause the steel strip to shift laterally, restoring forces increase approximately linearly with offset displacement. Since the heat sink conveyor is also used to produce an electromagnetic propulsion force in the longitudinal direction, it is imperative that the described invention contain a conveyor which has a significant transverse overhang with respect to the primary core width, such that the overhang is at least equal to one-quarter of a pole pitch. Conversely, it is not possible to have any transverse overhang for the steel strip undergoing solidification if a uniform thickness strip is required.

Although the present invention has been described in terms of what are at present believed to be its preferred embodiments, it will be apparent to those skilled in the art that various changes may be made without departing from the scope of the invention. It is therefore intended that the appended claims cover all such changes.

What is claimed is:

1. A system for casting of liquid metals having an electromagnetic pump comprising:

an upper primary block including a plurality of slots adjacent to one side thereof and a first polyphase winding passing through said upper primary block slots;

a lower primary block including a plurality of slots adjacent to one side thereof and a second polyphase winding passing through said lower primary block slots, said upper and lower primary blocks being positioned to form a gap therebetween;

a movable conductive heat sink disposed within said gap;

means for depositing liquid metal onto said heat sink, whereupon said liquid metal solidifies; and means for supplying an alternating current to said first and second polyphase windings for controlling the slip of said heat sink and said metal, thereby holding said heat sink and said metal in compression by electromagnetic forces placed on said heat sink and said metal as a result of a traveling electromagnetic wave in said gap produced by said alternating current flowing through said first and second polyphase windings.

2. A casting system as recited in claim 1, wherein alternating current flowing through said first and second polyphase windings imparts a new upward force on said heat sink and simultaneously imparts a net downward force on said metal.

3. A system as recited in claim 1, wherein said means for depositing liquid metal comprises a nozzle and wherein the transverse widths of said upper and lower primary blocks are identical and equal to the width of said nozzle.

4. A casting system as recited in claim 3, wherein said heat sink has a width which is greater than the width of said primary blocks with said heat sink being positioned to symmetrically extend beyond each side of said primary blocks, thereby causing additional transverse eddy currents to be induced in said heat sink such that the resultant shaded-pole action with said primary blocks centralizes said metal by electromagnetic forces.

5. A system for casting of liquid metals comprising:

an upper primary block including a plurality of slots adjacent to one side thereof and a first polyphase winding passing through said upper primary block slots;

a lower primary block including a plurality of slots adjacent to one side thereof and a second polyphase winding passing through said lower primary block slots, said upper and lower primary blocks being positioned to form a gap therebetween;

a movable conductive heat sink disposed within said gap;

means for depositing liquid metal onto said heat sink, whereupon said liquid metal solidifies;

said heat sink and said metal being held in compression by electromagnetic forces placed on said heat sink and said metal as a result of a traveling electromagnetic wave in said gap produced by alternating current flowing through said first and second polyphase windings;

wherein said means for depositing liquid metal comprises a nozzle and wherein the transverse widths of said upper and lower primary blocks are identical and equal to the width of said nozzle;

wherein said heat sink has a width which is greater than the width of said primary blocks with said heat sink being positioned to symmetrically extend beyond each side of said primary blocks, thereby causing additional transverse eddy currents to be induced in said heat sink such that the resultant shaded-pole action with said primary blocks centralizes said metal by electromagnetic forces; and a step reduction in the transverse thickness of that portion of said heat sink which overhangs said primary blocks.

6. A casting system as recited in claim 1, further comprising:

a conductive compensation sheet positioned within said gap and adjacent to said upper primary block.

7. A system for casting of liquid metals comprising:

an upper primary block including a plurality of slots adjacent to one side thereof and a first polyphase winding passing through said upper primary block slots;

a lower primary block including a plurality of slots adjacent to one side thereof and a second polyphase winding passing through said lower primary block slots, said upper and lower primary blocks being positioned to form a gap therebetween;

a movable conductive heat sink disposed within said gap;

means for depositing liquid metal onto said heat sink, whereupon said liquid metal solidifies;

said heat sink and said metal being held in compression by electromagnetic forces placed on said heat sink and said metal as a result of a traveling electromagnetic wave in said gap produced by alternating current flowing through said first and second polyphase windings; and wherein said first and second polyphase windings are wound in a double layer configuration and connected in series with each other.

8. A system for casting of liquid metals comprising:

an upper primary block including a plurality of slots adjacent to one side thereof and a first polyphase winding passing through said upper primary block slots;

a lower primary block including a plurality of slots adjacent to one side thereof and a second polyphase winding passing through said lower primary block slots, said upper and lower primary blocks being positioned to form a gap therebetween;

a movable conductive heat sink disposed within said gap;

means for depositing liquid metal onto said heat sink, whereupon said liquid metal solidifies;

said heat sink and said metal being held in compression by electromagnetic forces placed on said heat sink and said metal as a result of a traveling electromagnetic wave in said gap produced by alternating current flowing through said first and second polyphase windings; and wherein said lower primary block has a greater number of slots than said upper primary block and said second polyphase winding has a large number of coils than said first polyphase winding.

9. A system for casting of liquid metals comprising:

an upper primary block including a plurality of slots adjacent to one side thereof and a first polyphase winding passing through said upper primary block slots;

a lower primary block including a plurality of slots adjacent to one side thereof and a second polyphase winding passing through said lower primary block slots, said upper and lower primary blocks being positioned to form a gap therebetween;

a movable conductive heat sink disposed within said gap;

means for depositing liquid metal onto said heat sink, whereupon said liquid metal solidifies;

said heat sink and said metal being held in compression by electromagnetic forces placed on said heat sink and said metal as a result of a traveling electromagnetic wave in said gap produced by alternating current flowing through said first and second polyphase windings; and wherein said second polyphase winding is wound for a non-integral number of poles.

10. A system for casting of liquid metals comprising:

an upper primary block including a plurality of slots adjacent to one side thereof and a first polyphase winding passing through said upper primary block slots;

a lower primary block including a plurality of slots adjacent to one side thereof and a second polyphase winding passing through said lower primary block slots, said upper and lower primary blocks being positioned to form a gap therebetween;

a movable conductive heat sink disposed within said gap;

means for depositing liquid metal onto said heat sink, whereupon said liquid metal solidifies;

said heat sink and said metal being held in compression by electromagnetic forces placeed on said heat sink and said metal as a result of a traveling electromagnetic wave in said gap produced by alternating current flowing through said first and second polyphase windings; and shading coil loops on teeth formed between adjacent slots in said lower primary block adjacent to said nozzle.

11. A casting system as recited in claim 1, wherein the compression forces applied to said heat sink and metal are controlled by varying the excitation frequency in said first and second polyphase windings.

12. A method of electromagnetically pumping a solidifying liquid metal sheet deposited on a movable conductive heat sink, wherein the sheet and heat sink pass through a gap between a pair of primary blocks, each having a polyphase winding, said method comprising the steps of:

exciting the polyphase windings of the primary blocks with alternating current, thereby producing a traveling electromagnetic wave within said gap, to induce movement of said heat sink and said metal sheet; and controlling the frequency of excitation current in said polyphase windings to control the slip of said heat sink and said metal sheet, thereby controlling a compressive electromagnetic force produced by said traveling electromagnetic wave between said heat sink and said metal strip.

* * * * *